United States Patent [19]

Waldvogel

[11] 4,335,675

[45] Jun. 22, 1982

[54] COATING APPARATUS

[75] Inventor: Hartmut Waldvogel, Heidenheim, Fed. Rep. of Germany

[73] Assignee: J. M. Voith GmbH, Fed. Rep. of Germany

[21] Appl. No.: 174,692

[22] Filed: Jul. 31, 1980

[30] Foreign Application Priority Data

Aug. 4, 1979 [DE] Fed. Rep. of Germany ..... 2931800

[51] Int. Cl.[3] ..... B05C 1/08; B05C 11/02

[52] U.S. Cl. ..... 118/126; 118/249

[58] Field of Search ..... 118/126, 413, 414, 119, 118/249

[56] References Cited

U.S. PATENT DOCUMENTS

| | | | |
|---|---|---|---|
| 3,030,917 | 4/1962 | Brown et al. . | |
| 3,128,207 | 4/1964 | Schmitt | 118/126 |
| 3,169,082 | 2/1965 | Krikorian . | |
| 3,187,718 | 6/1965 | Coghill | 118/413 X |
| 3,363,603 | 1/1968 | Hill | 118/126 |
| 4,013,037 | 3/1977 | Warning, Sr. et al. | 118/685 |

*Primary Examiner*—John P. McIntosh

*Attorney, Agent, or Firm*—Ostrolenk, Faber, Gerb & Soffen

[57] ABSTRACT

A coating apparatus for coating a moving web is disclosed. A scraper element is provided, transverse to the direction of travel of the web, for scraping excess coating material therefrom. The scraper element has three positions: a rest position, in which it is relatively distant from the web; a ready position, in which it is maintained a short distance from the surface of the web, preferably about 1 mm; and an operating position, in which it is pressed against the web. A positioning member includes a first subsystem for moving the scraper element from the rest position to the ready position and a second subsystem for moving the scraper element from the ready position to the operating position. The second subsystem preferably contains a pneumatic pressure element, and the first includes either a pneumatic or a hydraulic pressure element. The two subsystems are connected to each other in series. Adjustable stops are preferably provided to limit the motion of the scraper element toward the web, thereby defining the operating position. In the preferred embodiment, independently adjustable stops are provided at both ends of the scraper edge, so that the pressure of the scraper element on the web can be made to vary across the width thereof.

4 Claims, 1 Drawing Figure

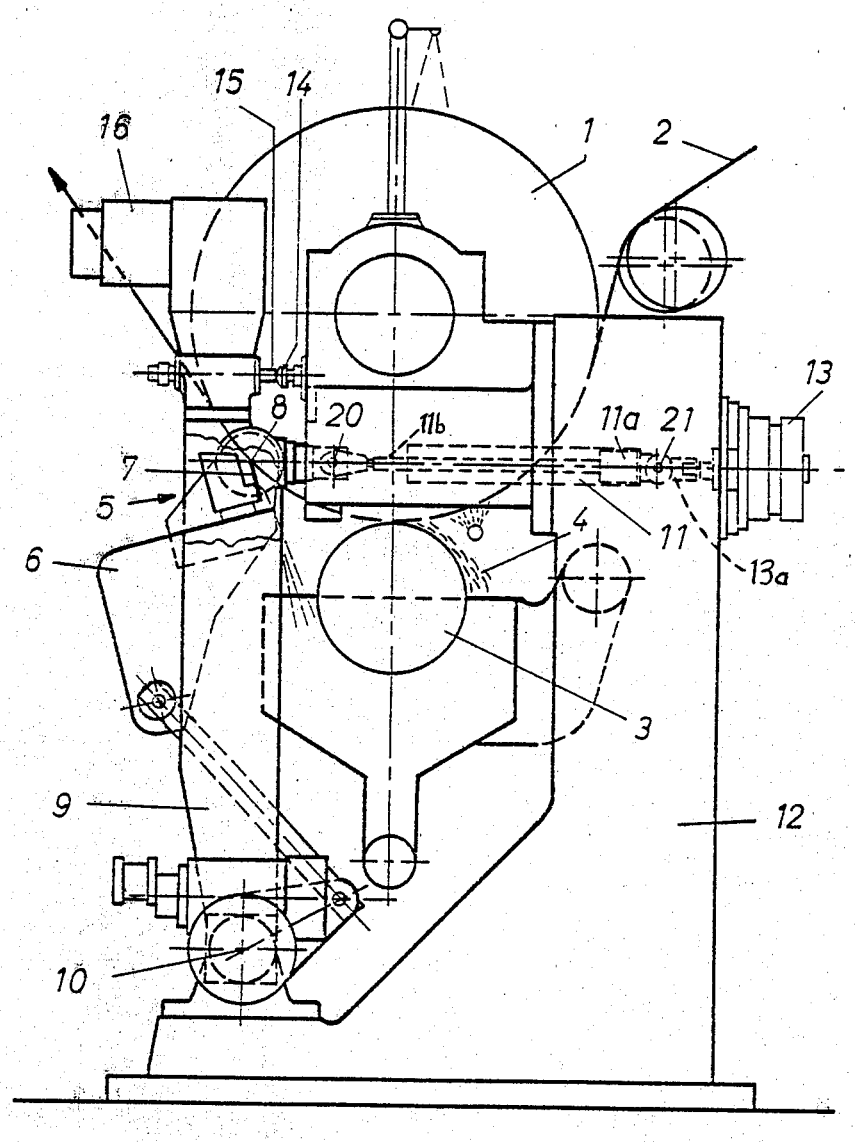
15
14
16
1
2
13
8
20
11b
11a
21
7
5
11
4
13a
6
3
9
12
10

COATING APPARATUS

BACKGROUND OF THE INVENTION

The present invention relates to a coating apparatus for coating moving webs, particularly webs of paper or cardboard, of the type in which a scraper element mounted on a scraper holder which extends transversely to the direction of travel of the web is used to scrape excess coating material off the web. In such apparatus, a stop determines the position of the scraper element relative to the web when it is operating to clean the excess coating material off the web. Positioning means are provided to move the scraper element between an operating position, in which the scraper element is pressed against the web, and a rest position, in which the scraper element is spaced from the web.

In the operation of such coating apparatus, it is important to obtain a layer of coating material which is as uniform in thickness as possible. The web can travel over a rotatable roller or over a stationary supporting device at the place where the excess coating composition is scraped off, or the web can travel between two symmetrically arranged scraper devices if it has been previously coated on both sides.

A coating apparatus of this kind is known, for instance, from the journal "Wochenblatt fuer Papierfabrikation", issue No. 16 (1978), pages 619 to 624. In that article, the scraper element (preferably a doctor blade) is moved relative to the scraper holder by means of an inflatable pressure hose. The scraper holder, which rests on two swing levers, can be moved by hydraulic cylinders from a position of rest in which it is spaced from the web toward the web until it is in the operating position, which is determined by stops. In this position the scraper element is initially stopped at a slight distance, for instance 1 mm, from the web which is to be coated. The scraper element is then applied to the coating material present on the traveling web by means of the inflation of the pressure hose. The latter presses the scraper element elastically against the web which is to be coated, the elasticity being present both in the direction towards the web and in the opposite direction (away from the web). This so-called "elastic travel" is desirable in most cases. The force with which the scraper element is pressed against the web can be varied by changing the pressure in the pressure hose.

For certain types of paper or cardboard or for certain coating materials, however, so-called "rigid travel" is desired. In a rigid travel arrangement, the scraper element is held rigidly in position relative to the scraper holder, regardless of variations in thickness of the web or of the layer of coating material applied thereto, and regardless of variations in the consistency of the coating material. However, a completely rigid attachment of the scraper element would result in the danger of the coating apparatus being damaged in the case of certain malfunctions in the operation of the apparatus, especially in the event of the web wrapping itself in several layers around the counter-roller.

SUMMARY OF THE INVENTION

The object of the present invention is to allow "rigid travel" operation without the danger of damaging the coating apparatus in the case of malfunctions.

This object is achieved according to the invention by providing a positioning means for moving the scraper element among three positions: an operating position, a ready position and a rest position.

In the ready position, the scraper element, which is arranged rigidly on the scraper holder, is maintained at a slight distance, for instance 1 mm, from the web. The entire scraper holder, preferably together with the swing levers to which it is fastened, is held by the positioning means at a certain distance from the stationary stops. Preferably, the positioning means includes two subsystems, the first of which moves the scraping element from the rest position to the ready position, and the second of which moves the scraper element from the ready position to the operating position. When either subsystem is active, the remaining subsystem is inactive.

In the preferred embodiment, the subsystem which moves the scraper element between the ready position and the operating position is preferably a pneumatic pressure element, and the two subsystems are preferably connected to each other in series. One should preferably be connected, at least indirectly, to the scraper holder, while the other is connected to the machine frame of the coating apparatus.

The force with which the scraper element is pressed against the traveling web is determined by changing the distance which the scraper holder can move from the ready position toward the web. For this purpose, there is provided a positioning motor, preferably an electric stepping motor of very high step-down ratio, so that the distance can be changed in extremely small increments and, therefore, can be set very precisely. Resetting the positioning motor in the ready position also serves to effect a correction in the pressing force, which is necessary when, for instance, the thickness of the coating is to be changed. The positioning motor can also be part of a control circuit which automatically maintains the thickness of the coating constant.

In the operating position, the scraper element is rigidly supported in the direction towards the counter-roller by the scraper holder, which rests against the stops which are secured to the machine frame. In this way, vibration of the scraper element is avoided. At the same time, however, the scraper element and the scraper holder have a certain amount of elastic play in the opposite direction (away from the web). This elasticity is provided by means of a compressible pressure fluid, preferably compressed air, in the pneumatic pressure elements. Because of this elasticity, the scraper holder, together with the scraper element, can yield, i.e. move somewhat away from the traveling web, in the event of any disturbance in operation.

The invention affords the further advantage that, if desired, the scraper element can be so fastened to the scraper holder that the pressing force of the scraper element against the web assumes locally different values corresponding to the desired transverse profile of the moving web or of the coating. This adjustment of the coating profile is effected independently of the basic setting of the pressing force.

Furthermore, the construction in accordance with the invention has the advantage that the force with which the scraper element acts on the coating material can be relatively large. This is because the value of the fluid pressure in the pneumatic pressure element can be selected independently of the pressing force desired.

Other objects and features of the invention will be apparent from the following description and the accompanying drawing.

BRIEF DESCRIPTION OF THE DRAWING

The figure shows the coating apparatus of the invention in a side view, partly in section.

DETAILED DESCRIPTION OF THE PREFERRED EMBODIMENT

The coating apparatus has a counter-roller 1 around the lower half of which there is guided a paper web 2 which is to be coated. Below the paper web 2, opposite the roller 1, there is a coating mechanism 3 by which coating material 4 is applied to the web 2. A scraper device 5 is arranged behind the coating mechanism 3 as viewed in the direction of movement of the web 2. This scraper device 5 comprises a scraper holder 6 on which there is rigidly fastened a preferably blade-like scraper element 7. The scraper holder 6 and the blade 7 both extend transverse to the direction of travel of the web 2, i.e. parallel to the axis of rotation of the roller 1. The scraper holder 6 is mounted on two levers 9 and is swingable about an axis 8 which passes at least approximately along the tip of the blade 7. The levers 9 are swingable about an axis 10. One of the levers 9 is arranged on each of the two lateral ends of the scraping device 5.

The levers 9 are swung around their axis 10 in the following manner. The piston rod **11*b* of a hydraulic cylinder 11 is pivoted to each lever 9 at the point 20. The cylinder 11 is pivoted at 21 to the piston rod 13*a* of a pneumatic cylinder 13, which is fastened to the machine frame 12. The two cylinders 11 and 13 are thus connected in series. The hydraulic cylinder 11 can execute a long stroke, while the pneumatic cylinder 13** is preferably a short-stroke cylinder.

The drawing shows the coating apparatus in the operating position, i.e. with the blade 7 pressed against the web 2. The coating apparatus also has a rest position (not shown), in which the levers 9 together with the scraper holder 6 and the blade 7 are spaced away from the roller 1, having been swung counterclockwise about axis 10. From this rest position, the blade 7, scraper holder 6 and levers 9 can be brought by the action of the hydraulic cylinder 11 into a third position, the ready position. In the ready position, the blade 7 is still spaced a slight distance from the counter-roller 1 and the web of paper 2. The distance between the blade 7 and the paper web 2 in the ready position may be, for example, 1 mm. In the ready position, the pistons **11*a* are inserted completely into their cylinders 11, and the piston rods 13*a* of the pneumatic cylinders are fully withdrawn from their cylinders 13. To move the scraper holder 6 and the blade 7 from the ready position to the operating position, i.e. toward counter-roller 1, the pneumatic cylinder 13 now presses the levers 9 against respective stops 14 which are rigidly connected to the machine frame 12. A respective stop part 15 cooperates with each stop 14. Each stop part 15 is arranged on the corresponding lever 9, and the extent to which the stop part 15 projects from the lever 9 can be adjusted in the direction of movement of the lever 9 by means of a positioning motor 16. A so-called stepping motor is preferably used as the positioning motor 16. A separate positioning motor 16 is preferably provided for each stop part 15**.

As a result of the construction described above, the scraper element 7 is pressed toward the counter-roller 1 against the coated paper web 2 as strongly and as far as the displaceable stop parts 15, which have been set by means of the stepping motors 16, allow.

In the ready position, the distance between the blade 7 and the paper web 2 may, for example, be about 1 mm. In this position, a spacing of, for instance, 5 mm is set between each stop 14 and the corresponding stop part 15 by means of the stepping motors 16. The pneumatic cylinders 13 move the levers 9 together with the scraper holder 6 and the blade 7 to the right (clockwise about axis 10) until the stops 14 and stop parts 15 contact each other, as shown in the drawing. As has already been stated, the last-described position is the operating position. In this position, the blade 7 is pressed against the paper web 2 with a predetermined force of application, deforming the blade 7 suitably for removing excess coating material from the web 2.

The present invention may be embodied in other specific forms without departing from the spirit or essential attributes thereof and, accordingly, reference should be made to the appended claims, rather than to the foregoing specification, as indicating the scope of the invention.

What is claimed is:

1. A coating apparatus for coating a moving web, comprising:

a machine frame;

a coating mechanism for applying a coating material to a web moving through said coating apparatus;

a scraper device, comprising a scraper holder and a scraper element supported on and movable with said scraper holder; said scraper holder and said scraper element both extending transversely to the direction of travel of the web; said scraper element being for scraping excess coating material from the web; said scraper element being movable, along with said scraper holder, relative to said machine frame among three positions, said three positions being a rest position in which said scraper element is relatively remote from the web, a ready position in which said scraper element is relatively close to the web, and an operating position in which said scraper element scrapes the web; and positioning means for moving said scraper element among said positions; said positioning means including a swing lever pivotally mounted to a swing axis on said machine frame, and said scraper holder being fastened to said swing lever remote from said swing axis; a positioning member connected with said swing lever for moving said scraper element together with said scraper holder from said rest position to said ready position; said positioning means further comprising a pneumatic pressing element connected in series with said positioning member for operating through said positioning member to displace said swing lever from the position of said swing lever wherein said scraper element is in said ready position to the position of said swing lever wherein said scraper element is in said operating position;

said positioning means further comprising a stop secured to said machine frame for being abutted by said swing lever for positioning said swing lever where said scraper element is in said operating position; a positioning motor for displacing said stop in such a manner as to vary said operating position, thereby to adjust the pressure of said scraper element on the web.

2. The apparatus of claim 1, wherein said scraper element has two ends transversely across the web; and said positioning means further comprising at least two said stops and an equal number of positioning motors for displacing respective ones of said stops, at least one said stop and the corresponding said positioning motor being located at each said end of said scraper element; said positioning motors being operable independently of each other, whereby the pressure exerted by said scraper element on the web can be made to vary across the width of the web.

3. The apparatus of claim 1, wherein said pneumatic pressure element has a piston whose effective diameter is greater than its stroke.

4. The apparatus of claim 1, wherein said positioning member also comprises a pneumatic pressure element.

* * * * *